United States Patent [19]

Feiler

[11] Patent Number: 4,913,289

[45] Date of Patent: Apr. 3, 1990

[54] UNITARY WATCH DISPLAY SYSTEM

[76] Inventor: Robert J. Feiler, 517 West 29th St., New York, N.Y. 10001

[21] Appl. No.: 231,359

[22] Filed: Aug. 12, 1988

[51] Int. Cl.[4] ..... B65D 1/34

[52] U.S. Cl. ..... 206/566; 206/44.11; 206/45.14; 206/45.19; 206/6.1

[58] Field of Search ..... 206/44.11, 45.16, 45.18, 206/558, 566, 557, 45.19, 45.14; 312/117, 118

[56] References Cited

U.S. PATENT DOCUMENTS

| | | | |
|---|---|---|---|
| 1,476,474 | 12/1923 | Stahfest | 206/45.18 |
| 1,517,537 | 12/1924 | Daggett | 206/45.18 |
| 1,625,754 | 4/1927 | Tobita | 206/566 |
| 1,645,807 | 10/1927 | Grant | 206/45.18 |
| 1,774,430 | 8/1930 | Flier | 206/566 |
| 2,639,033 | 5/1953 | Michaelson et al. | 206/45.18 |
| 3,136,411 | 6/1964 | Wright | 206/45.18 |
| 4,094,409 | 6/1978 | Sprangler et al. | 206/566 |
| 4,195,727 | 4/1980 | Mele | 206/566 |
| 4,432,456 | 2/1984 | Ovadia et al. | 206/45.19 |
| 4,650,077 | 3/1987 | Droz | 206/566 |

FOREIGN PATENT DOCUMENTS

| | | | |
|---|---|---|---|
| 544586 | 2/1977 | U.S.S.R. | 206/45.18 |

OTHER PUBLICATIONS

W. R. Wanesky, "Package for Transporting Beam--Load Devices on a Substrate", Jul. 1969, p. 19.

*Primary Examiner*—David T. Fidei
*Attorney, Agent, or Firm*—Edward Callahan

[57] ABSTRACT

A display system for showing watches on a shelf of a showcase including a support structure having a first platform for positioning a plurality of watch collars mounting watches over a substantial area of the first platform and a second platform opposed to the first platform for supporting a plurality of independent watch displays mounting watch collars in turn mounting watches on selected areas of the second platform. The support structure is movable to either a full watch display position or a reduced watch display position, the full watch display position being when the first platform is oriented facing upward and the second platform is oriented facing downward, and the partial watch display position being when the second platform is oriented facing upward and the first platform is oriented facing downward so that the support structure can be selectively reversed in accordance with either high or low merchandise levels. The display system includes a housing for removably holding the support structure in either the full or the reduced watch display position. The housing is hollow and has an inner shelf for holding the support structure. The housing and the inner shelf are angled so as to present the first or second platforms at an angle relative to the customer. The housing and the support structure define an inner volume for storing articles.

19 Claims, 5 Drawing Sheets

UNITARY WATCH DISPLAY SYSTEM

FIELD OF THE INVENTION

This invention relates generally to the art of jewelry display for retail sale and more specifically to the art of watch display.

BACKGROUND OF THE INVENTION

The art of jewelry display relates to the showing of certain precious commodities in a glass showcase to customers for retail sale purposes. Watches are considered to be one of the commodities shown in this manner.

Sales of jewelry including watches increase and decrease sharply in accordance with particular seasons of the year. In particular, during the Christmas season when customer demand is strong, a large number of watches are in inventory and many are displayed in showcases by retailers. Immediately after Christmas, customer demand drops precipitously and merchandise levels are kept low.

Watches displayed for retail sale in glass showcases are mounted on "steps", or "elevations", which in turn rest on the floor of the glass showcase. A number of elevations are positioned adjoining one another. An easel, or tilt support, is generally placed under the elevation at its rear edge so as to present the elevation to customers at a slant. The easels are generally of slightly different sizes so that the elevations are presented at different angular slants. A first type of elevation used in seasons of high merchandise levels has a topside and a back side. The topside has a number of blocks, or parallel channels, for holding watch collars, which in turn support individual watches. The first type of elevation is typically capable of holding in the range of thirty watches. The back side has no function and is provided with a backing, generally of paper, which covers over the edges of the fabric covering of the elevation. Because merchants want to avoid having empty watch blocks, a second type of elevation is used in seasons of low merchandise levels. The second type of elevation has a level topside covered in fabric and, like the first type of elevation, has a backside having no function and provided with a backing, generally of paper, which covers over the edges of the fabric. Any of several types of small, independent watch displays each holding one or several watches are in turn mounted on the topside level surface of the second type of elevation. The second type of elevation presents many fewer watches than presented in the first type of elevation yet in an aesthetic manner. Thus, the retailer is able to show an artful display of watches in times of both high and low merchandise levels.

The problem with this system is that two completely different sets of elevations are needed by merchants over the course of a year. One or the other of the sets of elevations must be stored away during their time of non-use, a procedure that has several disadvantages. The major disadvantage is that the environment of the showcase must be disturbed at every change of selling season. Another disadvantage is that the stored elevations may be misplaced and are not available when they are needed. Yet another disadvantage is that convenient space must be found to store the unused sets of elevations.

SUMMARY OF THE INVENTION

Accordingly, it an object of this invention to provide a unitary watch display system which provides the capability of showing either a high or a low level of watch inventory without disturbing the overall display environment;

It is another object of this invention to provide a unitary watch display elevation which can be used for times of both high and low merchandise levels; and It is another object of this invention to provide a unitary watch display unit including an elevation which can be used at times of both high and low merchandise levels.

In accordance with these an other objects that will become apparent in the course of this disclosure, there is provided a display system for showing watches on a shelf of a showcase including a support structure having a first platform for positioning a plurality of watch collars mounting watches over a substantial area of the first platform and a second platform opposed to the first platform for supporting a plurality of independent watch displays mounting watch collars in turn mounting watches on selected areas of the second platform. The support structure is movable to either a full watch display position or a reduced watch display position, the full watch display position being when the first platform is oriented facing upward and the second platform is oriented facing downward, and the partial watch display position being when the second platform is oriented facing upward and the first platform is oriented facing downward so that the support structure can be selectively reversed in accordance with either high or low merchandise levels. The display system includes a housing for removably holding the support structure in either the full or the reduced watch display position. The housing is hollow and has an inner shelf for holding the support structure. The housing and the inner shelf are angled so as to present the first or second platforms at an angle relative to the customer. The housing and the support structure define an inner volume 50 for storing articles, such as watches 22, as illustrated in FIGS. 7 and 8.

The present invention will be better understood and the objects and important features, other than those specifically set forth above, will become apparent when consideration is given to the following details and description, which when taken in conjunction with the annexed drawings, describes, discloses, illustrates, and shows preferred embodiments or modifications of the present invention and what is presently considered and believed to be the best mode of practice in the principles thereof.

Other embodiments or modifications may be suggested to those having the benefit of the teachings therein, and such other embodiments or modifications are intended to be reserved especially as they fall within the scope and spirit of the subjoined claims.

DESCRIPTION OF THE PREFERRED EMBODIMENT

Reference is now made in detail to the drawings wherein the same numerals refer to the same or similar elements throughout.

Figure 1:
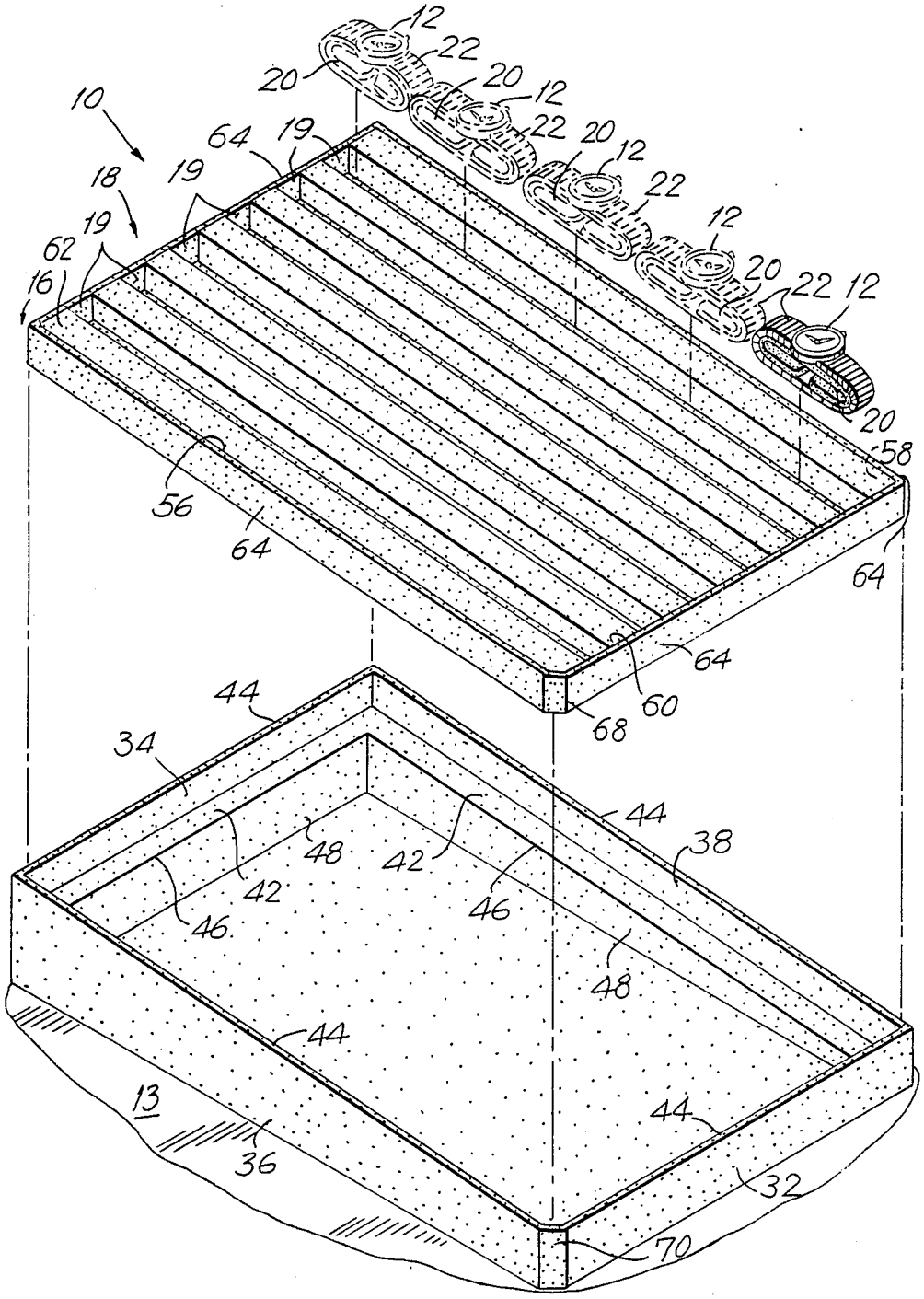
FIG. 1 is an exploded perspective view of a unitary watch display unit adapted for a time of high merchandise level.
Figure 2:
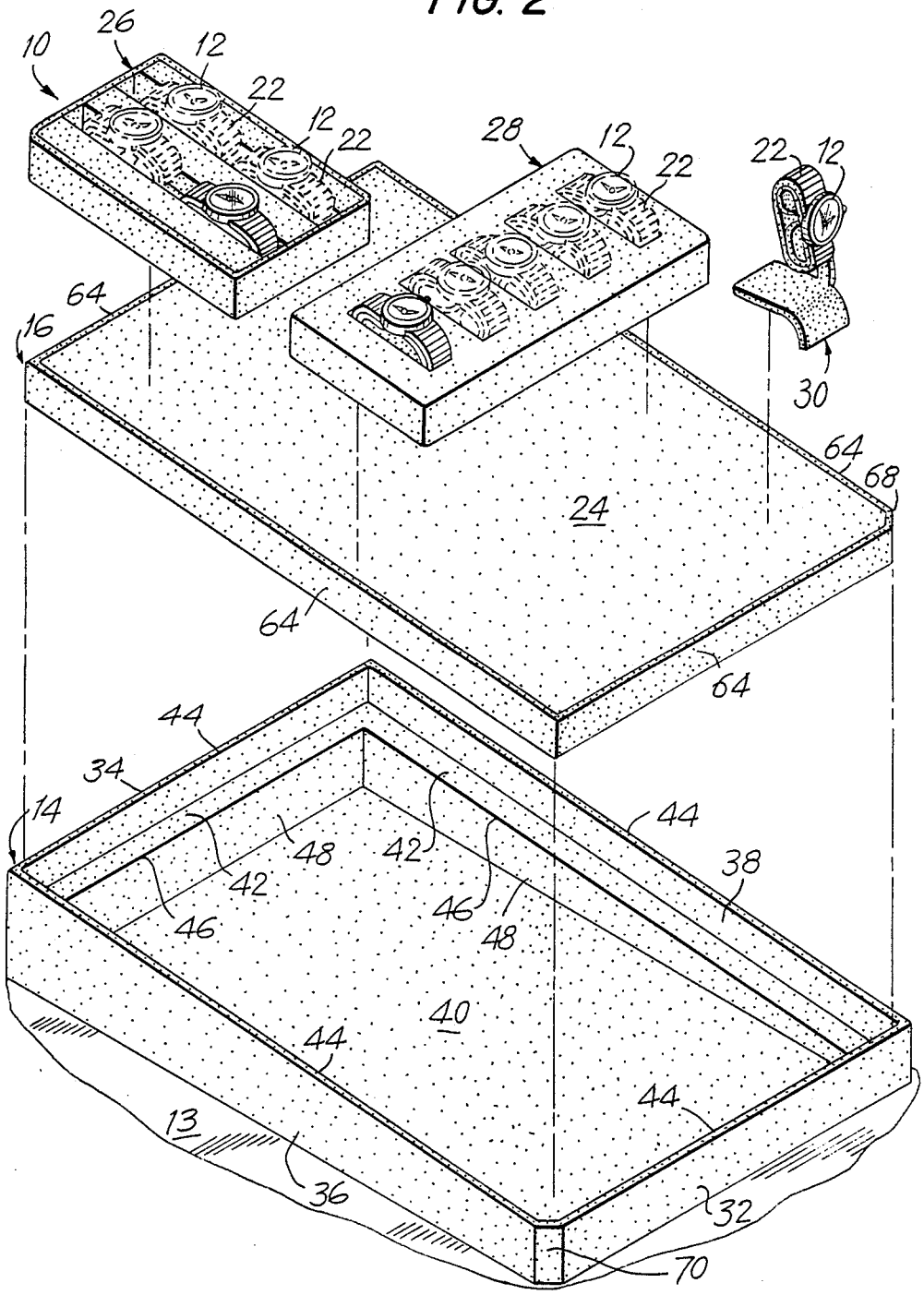
FIG. 2 is an exploded perspective view of the same unitary watch display unit illustrated in FIG. 1 adapted for a time of low merchandise level.

A display system 10 for showing watches 12 on a shelf 13 of a showcase is illustrated in exploded perspective in FIGS. 1 and 2 and in top and sectional views in FIGS. 3-8. Display system 10 includes a housing 14 and a support structure 16 removably positioned in housing 14. Support structure 16 includes a rectangular first platform 18 (FIG. 1) having six equally spaced parallel blocks, or channels, 19 extending transversely to the line of sight of a viewer of the showcase for positioning thirty watch collars 20 of the type known in the art, which in turn mount thirty watches 12 by way of watch straps 22 substantially entirely over the area of first platform 18. Support structure 16 further includes a rectangular, flat second platform 24 (FIG. 2) opposed to first platform 18 and which supports three independent watch displays 26, 28, and 30 mounting ten watch collars 20 in turn mounting ten watches 12 by way of watch straps 22 on selected areas of second platform 24.

Figure 4:
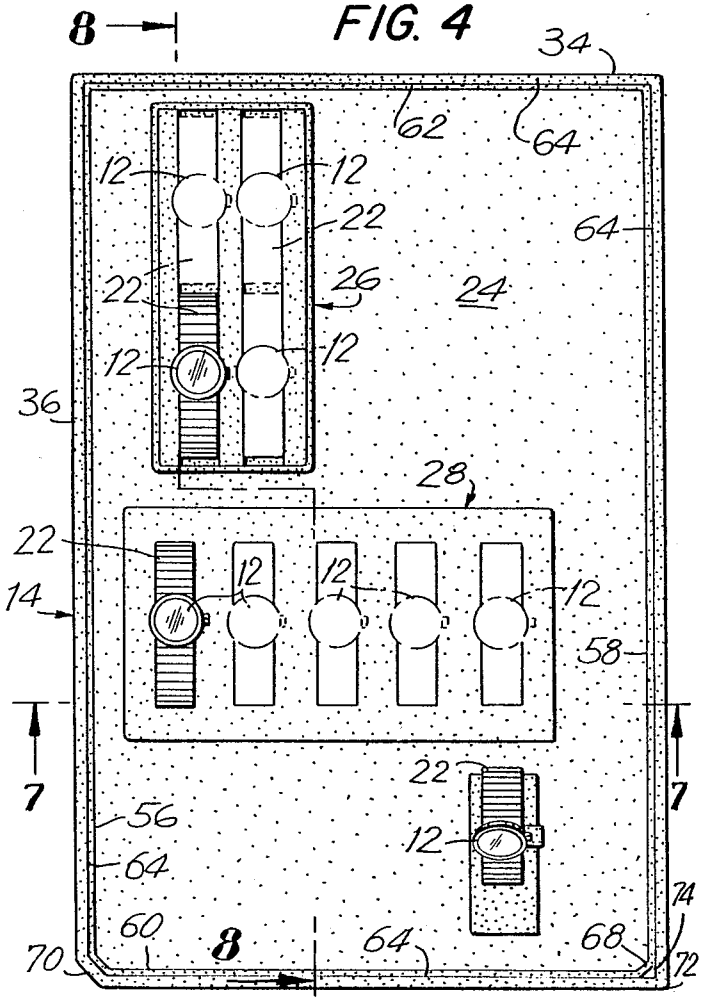
FIG. 4 is a top view of the unitary watch display unit adapted for a time of low merchandise level.
Figure 3:
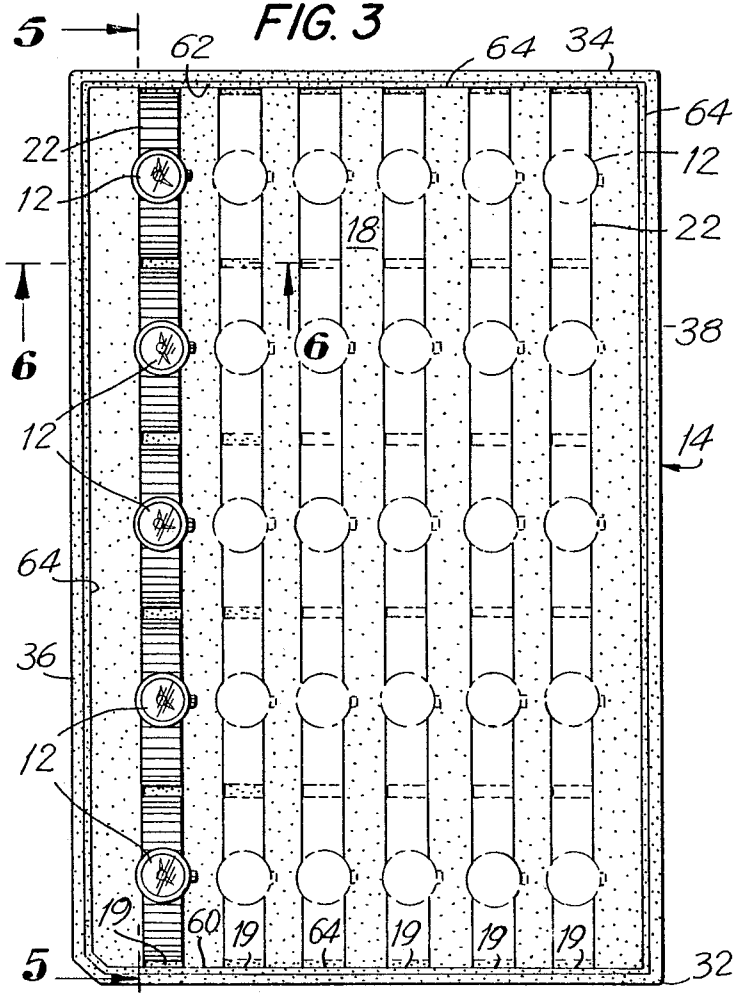
FIG. 3 is a top view of the unitary watch display unit adapted for a time of high merchandise level.
Figure 5:
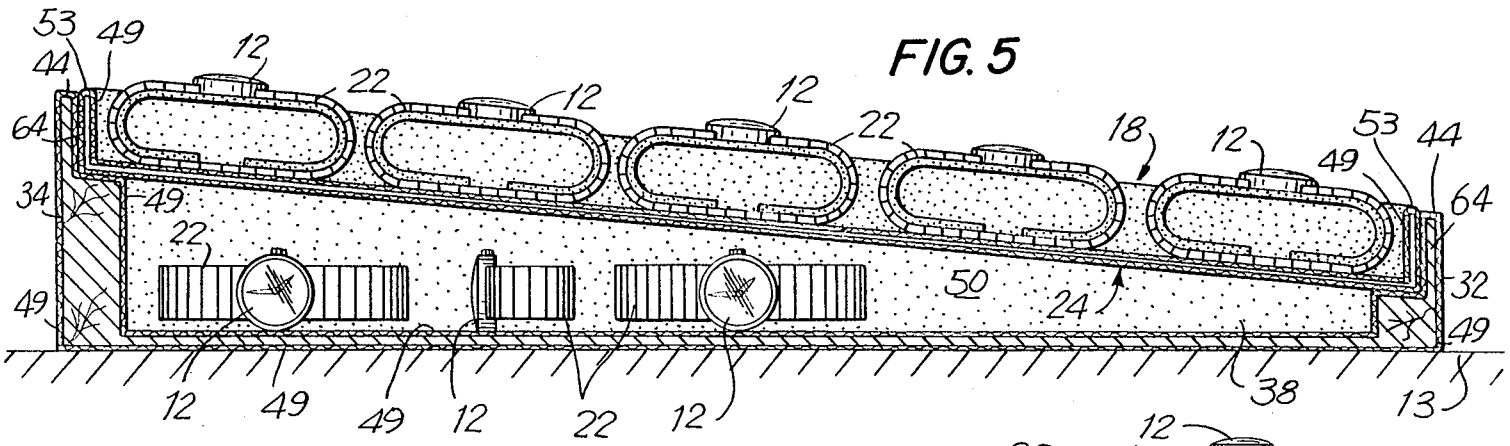
FIG. 5 is a view taken through line 5—5 in FIG. 3.
Figure 6:
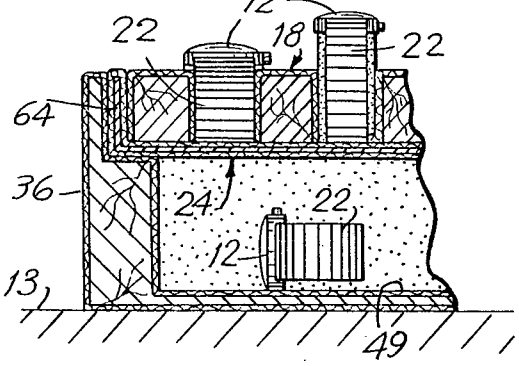
FIG. 6 is a view taken through line 6—6 in FIG. 3.

Support structure 16 is movable by a user to either a full watch display position or a reduced watch display position. The full watch display position is when first platform 18 is oriented facing upward and second platform 24 is oriented facing downward as illustrated in FIGS. 1 and 3. The partial watch display position is when second platform 24 is oriented facing upward and first platform 18 is oriented facing downward as illustrated in FIGS. 2 and 4. Thus, support structure 16 can be selectively reversed in its position in housing 14 in accordance with either high or low merchandise levels, which are in turn seasonal in the jewelry retail field. Support structure 16 is reversed in position by its being manually lifted from housing 14, rotated to its opposite position, and then reset in housing 14.

Housing 14 includes oppose vertical front and rear walls 32 and 34, respectively, and opposed vertical left and right side walls 36 and 38, respectively, connected to front and rear walls 32 and 34, and a bottom wall 40 connected to front and rear walls 32 and 34 and side walls 36 and 38. Front and rear walls 32 and 34 and side walls 36 and 38 have inner surfaces, and a continuous rectangular shelf 42 extends transversely inwardly from the inner surfaces. Support structure 16 is positioned in housing 14 on shelf 42 with either first platform 18 or second platform 24 being in contact with shelf 42 depending on the selected position of support structure 16. Front and rear walls 32 and 34 and side walls 36 and 38 include a continuous, rectangular top edge 44 spaced equally from shelf 42. The surface of either first or second platform 18 or 24 depending on which is oriented facing upward is aligned with top edge 44.

Housing 14 is tilted so as to present support structure 16, and more particularly either first and second platform 18 or 24, at an angle to customers in either the full or partial display position. In particular, rear wall 34 has a first height and front wall 32 has a second height greater than the first height, and side walls 36 and 38 are configured as truncated triangles so that their top edges slant downward from rear wall 34 to front wall 32, so that either first or second platform 18 or 24 is angled relative to customers depending on which platform is being used for display purposes. Housing 14 is covered with a fabric 49 such as velvet or faux suede.

Shelf 42 includes an inner edge 46 and an inner shelf surface 48 which extends vertically downward from inner edge 46 to bottom wall 40. Vertical shelf surface 48, bottom wall 40, front and rear walls 32 and 34, and either first or second platforms 18 and 24, whichever is facing downward, define a volume 50 in which articles can be stored.

Support structure 16 includes a generally solid body, or base, 52, which is configured as a parallelepiped and is covered by a fabric 53 such as velvet or faux suede matching fabric 49 of housing 14. Base 52 along with fabric 53 defines channels 19. Five watch collars 20 each holding a watch 12 are positioned in each channel 19 so that thirty watches can be displayed on the full display first platform 18. First platform 18 has a first platform area and channels 19 are located substantially entirely over the first platform area. The area of first platform 18 and the number and length of channels 19 are illustrated for purposes of exposition only and can vary in accordance with circumstances.

Base 52 also includes flat second platform 24 opposed to first platform 18. Second platform 24 has a second platform area equal to the first platform area. Independent watch display 26 has two parallel front-to-back channels in each of which are positioned two watch collars 20 holding two watches 12 for a total of four watches. Independent watch display 28 has five single-capacity channels in which are positioned five watch collars 20 holding five watches. Independent watch display 30 is an individual watch display supporting one watch collar 20 with one watch 12. Thus, the partial display of second platform 24 displays ten watches. The number, type, and positioning of independent watch displays 26, 28, and 30 are shown for purposes of exposition only and can vary in accordance with circumstances.

Base 52 has a pair of opposed side walls 56 and 58 and opposed front and back walls 60 and 62, respectively, at which channels 19 open. Support structure 16 includes a stiff border 64 attached to side walls 56 and 58 and front and back walls 60 and 62 of bas®52 and more particularly to fabric 53 covering the stated areas of base 52 so as to completely enclose base 52. Fabric 53 also separately covers border 64.

Support structure 16 forms a bevel 68 at the junction of front wall 32 and side wall 56, and housing 14 also forms a bevel 70 at the junction of front wall 60 left side wall 36. Bevel 68 is flush with bevel 70 when support structure 16 is positioned in the full display position with first platform 18 facing upward and is slightly spaced from a square corner 72 at the junction of front wall 32 and right side wall 38 of support structure 16 so that a pocket 74 is formed between bevel 68 and square corner 72 so as to allow a finger or tool hold in pocket 74 when the partial display of second platform 24 is facing upward. Support structure 16 also forms a bevel corner 75 at the junction of front wall 32 and left side wall 36 so that bevel 70 is flush with bevel corner 75 when the full display of first platform 18 is facing upward.

Figure 9:
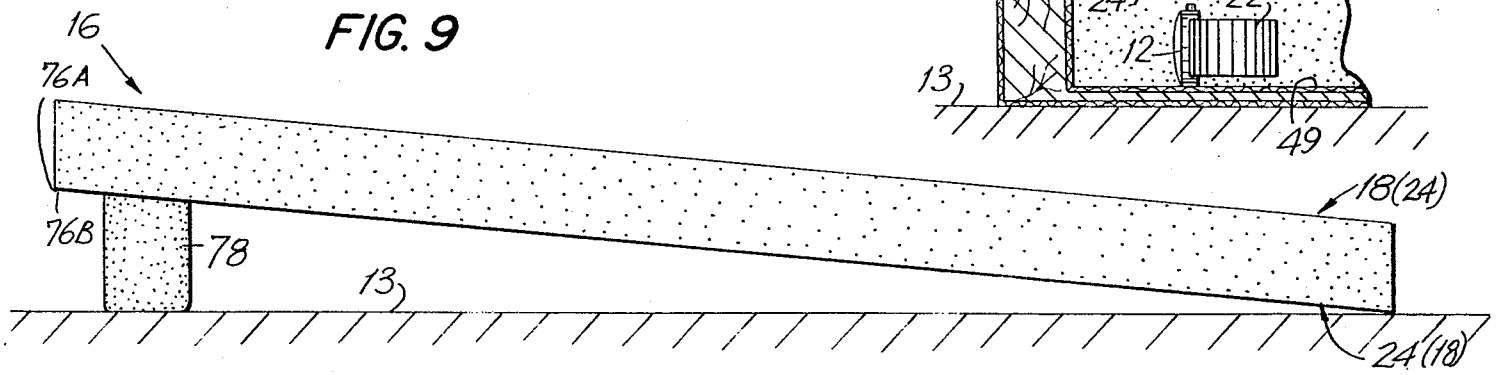
FIG. 9 is a side view taken of a unitary watch display elevation with a tilt support member.
Figure 7:
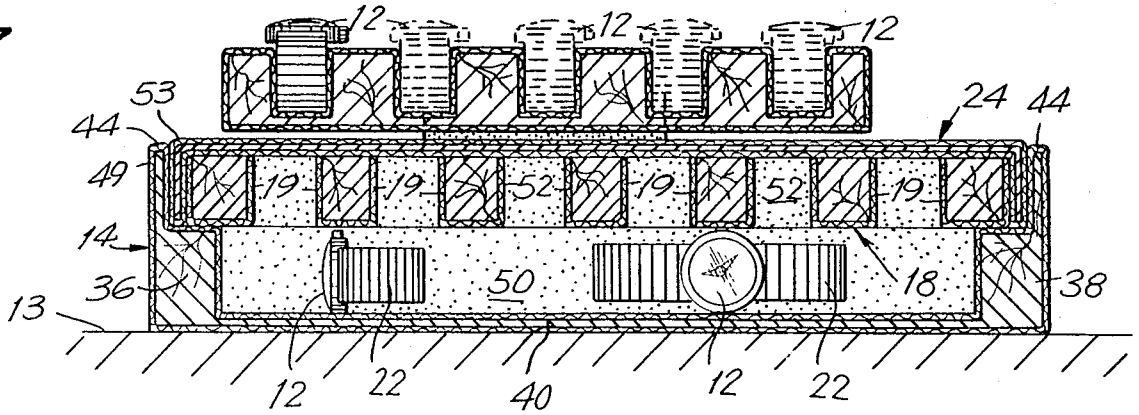
FIG. 7 is a view taken through line 7—7 in FIG. 4.
Figure 8:
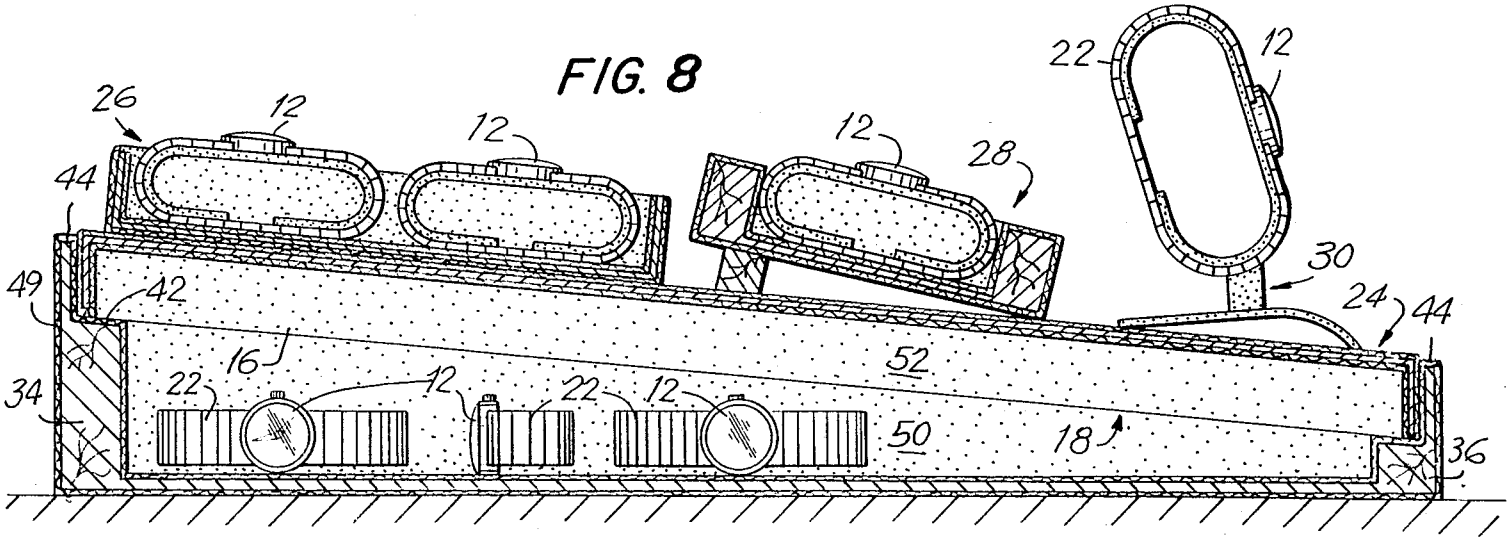
FIG. 8 is a view taken through line 8—8 in FIG. 4.

Support structure 16 can be used alone in a showcase as shown in the side elevation view of FIG. 9. Support structure 16 includes a rear bottom edge defined by rear wall 62 and either first platform 18 or second platform 24 and indicated as rear bottom edge 76A or 76B, respectively, depending upon whether first platform 18 or second platform 24 is facing downward. Rear bottom edge 76A or 76B is positioned distal from the customers. An easel, or tilt support, 78 is positioned in contact with either first or second platform 18 or 24 at either rear bottom edge 76B or 76B and with showcase shelf 13 when support structure 16 is positioned in either the reduced or the full watch display position, respectively. Tilt support 78 elevates the rear portion of support structure 16 in order to present watches 12 at an angle to the customers.

Although the present invention has been described in some detail by way of illustration and example for purposes of clarity and understanding, it will, of course, be understood that various changes and modifications may be made in the form, details, and arrangements of the parts without departing from the scope of the invention set forth in the following claims.

What is claimed is:

1. A display system for showing watches on a shelf to customers, including, in combination, a support structure, said support structure including first platform means for positioning a plurality of watch collars mounting watches over a substantial area of said first platform means, said support structure further including second platform means opposed to said first platform means for supporting a plurality of independent watch displays mounting watch collars mounting watches on selected areas of said second platform means, said second platform means being parallel to said first platform means.

said support structure further including a continuous side wall joining said first and second platforms means, and a fabric covering said support structure including said first and second platform means and said continuous side wall, said support structure being movable between first and second watch display positions, said first watch display position being when said first platform means is oriented facing upward for viewing and said second platform means is oriented facing downward, and said second watch display position being when said second platform means is oriented facing upward for viewing and said first platform means is oriented facing downward said first platform means including a first platform defining a plurality of parallel channels in which are positioned said plurality of watch collars with watches, said first platform having a first platform area, said plurality of parallel channels being located substantially entirely over said first platform area, said fabric covering said first platform and said plurality of parallel channels, said second platform means including a second platform opposed to said first platform, said second platform including a substantially flat surface, said plurality of independent watch displays being positioned on selected platform areas of said flat surface, said fabric covering said flat surface.

2. The display system according to claim 1, said support structure including a rear wall and first and second rear bottom edge areas defined by said rear wall and either said first platform or said second platform, respectively, depending upon whether said first or said second watch display position is used, respectively, and further including tilt support means positioned in contact with either said first or said second rear bottom edge area in contact with the shelf, said tilt support means being for presenting the watches at an angle to the customers when said rear bottom edge is located distal from the customers.

3. The display system according to claim 2, further including housing means for removably holding said support structure in either said first or said second watch display position.

4. The display system according to claim 3, wherein said housing means includes tilt means for presenting said support structure at an angle to the customers in either said first or said second watch display position.

5. The display system according to claim 4, wherein said housing means includes a housing having vertical front and rear walls and opposed vertical side walls connected to said front and rear walls, a bottom wall connected to said front and rear walls and said side walls, said front and rear walls and said side walls having inner surfaces, and a continuous shelf extending transversely inwardly from said inner surfaces, said support structure being positioned in said housing means on said continuous shelf.

6. The display system according to claim 5, wherein said front and rear walls and said side walls include a continuous top edge spaced equally from said continuous shelf, and said first or second platform is generally aligned with said top edge.

7. The display system according to claim 6, wherein said tilt means includes said rear wall having a first height and said front wall having a second height greater than said first height, said side walls being configured as truncated triangles.

8. The display system according to claim 7, wherein said continuous shelf includes an inner edge and an inner shelf surface extending vertically downward from said inner edge to said bottom wall, said inner shelf surface, said bottom wall, said front and bottom wall, and either said first or second platform defining a volume, whereby articles can be stored in said volume.

9. The display system according to claim 8, wherein said plurality of parallel channels are oriented to extend between said front and rear walls of said housing.

10. The display system according to claim 8, wherein said platform is configured as a parallelpiped, and said continuous top edge of said housing is configured as a parallelpiped.

11. The display system according to claim 8, wherein said housing is covered with another fabric matching said fabric covering said support structure.

12. The display system according to claim 1, wherein said fabric is faux suede.

13. The display system according to claim 1, wherein said fabric is velvet.

14. The display system according to claim 11, further including a stiff border attached to said continuous side wall and more particularly to said fabric covering said continuous side wall, and further including a border fabric matching said fabric covering said support structure.

15. A housing system for an elevation, the elevation including a display platform having an edge and a continuous elevation side wall of uniform height connected to the edge, the display platform being for supporting jewelry shown to customers, including, in combination, housing means for removably holding the elevation in a jewelry display position wherein the display platform faces upward, said housing means including a continuous vertical side wall, a bottom wall connected to said continuous side wall, said continuous side wall having a continuous inner surface, and a continuous shelf extending transversely inwardly from said continuous inner surface spaced above said bottom wall, the elevation being positioned in said housing means on said continuous shelf, said continuous side wall including a continuous top edge spaced equally from said continuous shelf, said continuous side wall including a rear wall having a first height and a front wall opposed to said rear wall, said front wall having a second either greater than said first height, said side walls being configured as truncated triangles, said shelf being tilted relative to the horizontal, whereby said platform can be positioned on said shelf at an angle.

16. The housing according to claim 15, wherein said continuous shelf, said bottom wall, said continuous side wall, and said platform positioned on said continuous shelf define a volume, whereby articles can be stored in said volume.

17. The display system according to claim 1, wherein said support structure is configured as a parallelepiped.

18. The housing system in accordance with claim 15, wherein said platform is aligned with said top edge.

19. A housing system for an elevation, the elevation including a display platform having an edge and a continuous elevation side wall connected to the edge, the display platform being for supporting jewelry shown to customers, including, in combination, housing means for removably holding the elevation in a jewelry display position wherein the display platform faces upward, said housing means including a continuous vertical side wall, a bottom wall connected to said continuous side wall, said continuous side wall having a continuous inner surface, and a continuous shelf extending transversely inwardly from said continuous inner surface spaced above said bottom wall, the elevation being positioned in said housing means on said continuous shelf, said continuous side wall including a continuous top edge spaced equally from said continuous shelf, said continuous side wall including a rear wall having a first height and a front wall opposed to said rear wall, said front wall having a second height greater than said first height, said side walls being configured as truncated triangles, said shelf being tilted relative to the horizontal, whereby said platform can be positioned on said shelf at an angle.

* * * * *